United States Patent [19]

Thompson

[11] Patent Number: 5,007,257

[45] Date of Patent: Apr. 16, 1991

[54] SAFETY SHIELD FOR DOUBLE-LOCK HANDCUFFS

[76] Inventor: Charles E. Thompson, 945 Garfield St., Oak Park, Ill. 60304

[21] Appl. No.: 594,414

[22] Filed: Oct. 9, 1990

[51] Int. Cl.[5] ..... E05B 75/00

[52] U.S. Cl. ..... 70/16; 224/914

[58] Field of Search ..... 70/15–17; 224/914; 119/128

[56] References Cited

U.S. PATENT DOCUMENTS

| | | | |
|---|---|---|---|
| 3,007,331 | 11/1961 | Irwin | 70/16 |
| 3,616,665 | 11/1971 | Rosenthal | 70/16 |
| 3,740,977 | 6/1973 | Stefansen et al. | 70/16 |
| 4,509,346 | 4/1985 | Szczepanek | 70/16 |
| 4,741,051 | 5/1988 | Bible | 70/16 X |
| 4,840,048 | 6/1989 | Elam | 70/16 |

*Primary Examiner*—Lloyd A. Gall

*Attorney, Agent, or Firm*—David D. Kaufman

[57] ABSTRACT

A safety shield for double-lock handcuffs having a first lock for disengaging or releasing the wristlets after the same have been applied to the wrists of a prisoner, and a second lock for fixing the preset contracted position of the wristlets on the prisoner's wrists. The box-like shield comprises access slots in a wall thereof through which a portion of the associated handcuff key may be inserted to actuate the second lock without opening the shield or revealing the first lock or removing the shield from the handcuffs. This arrangement permits the shield to be secured over the handcuffs prior to application to a prisoner and thereby enhances the officer's safety.

7 Claims, 2 Drawing Sheets

SAFETY SHIELD FOR DOUBLE-LOCK HANDCUFFS

BACKGROUND OF THE INVENTION

This invention relates generally to a cover or shield cooperable with prisoner handcuffs for making the handcuffs safer and more tamper-proof and, more particularly, to a safety shield for use with double-lock handcuffs.

Handcuffs used by police and law enforcement officers worldwide for prisoner restraint are basically standardized in construction and operation. Typically, the handcuffs comprise a pair or wristlets either hingedly connected or, more frequently, joined together by a short link chain. Each wristlet has a single strand or ratchet bar which automatically engages the teeth in a double strand and is thus pivotal or rotatable through the double strand in only one direction. Once applied to the wrists of a prisoner, the ratchet bar can be released or disengaged only with a key insertable into a keyhole or first lock on the wristlet.

While on the wrists of a prisoner, the ratchet bar is still squeezable or rotatable inwardly through the double strand to make the encircling circumference progressively smaller. This capability could of course cause injury to the prisoner. To prevent such injury, standard handcuffs are provided with a second lock for fixing the wristlet circumference preset by the officer on the prisoner's wrist. The second lock typically comprises a recessed rod within a small hole that can be actuated by a projection or pin on the key carried by the officer. Use of the key to open the first lock can also open or disengage the second lock so that the handcuffs are ready for further use.

Use of the handcuffs with chain-connected wristlets can frequently place arresting officers in dangerous and even life threatening situations. Since the connection between the wristlets is flexible and rotatable, the manacled prisoner is able to manipulate his hands with a large degree of freedom. Picking of the locks is thus a possibility. Also, when applying the handcuffs, the officer is standing close to the prisoner and is in physical jeopardy if the prisoner is violent or struggling. If the handcuffs are applied to only one wrist at a time, the physical danger is in no way reduced because the rotatable and pivotal connection between the two wristlets affords the officer scant leverage even over the wrist that is manacled.

Efforts have been made to improve the safety aspects of conventional handcuffs. Thus, for example, U.S. Pat. No. 3,616,665 shows a shield that was passed over the handcuff chain to cover the key openings and maintain the chain in a taut condition. U.S. Pat. No. 3,740,977 shows a hinged cover assembly that was applied over the wristlets and connecting chain to rigidify the connection between the prisoner's wrists and also encase the key openings. Both of the identified prior structures were characterized by a disadvantageous feature in that they made no provision for actuation of the second or double lock. The handcuffs thus needed first to be applied to the prisoner's wrists and the second lock then actuated to fix the setting of the wristlets. Only after this dangerous operation was completed was the shield or cover applied to the handcuffs. The officer thus was subjected to the kinds of dangers described above during the hancuffing operation.

There thus exists a need for further improving the safety aspects of handcuff use and, particulary the need exists for a means to provide greater protection for the arresting officer during the initial handcuffing operation as well as subsequent thereto.

SUMMARY OF THE INVENTION

The present invention provides a shield for handcuffs which substantially eliminates the dangers and problems described. The inventive shield can be applied to the handcuffs before the prisoner is handcuffed to greatly improve the officer's advantage. The invention nonetheless permits the handcuffs to be double locked as required.

Briefly, the invention comprises an improvement over the type of handcuff cover shown in U.S. Pat. No. 3,740,977. The invention thus comprises a hinged, box-like assembly adapted to be locked over the handcuff chain and wristlets and the keyholes of the first locks. The shield comprises additionally access means in a wall thereof aligned with the second locks when the cover is operationally positioned and closed over a pair of handcuffs. The access means permits access to the second locks with a portion of the key carried by the officer. As a result, the handcuffs may be operationally locked within the shield prior to the time that their use in shackling a prisoner is required. Once the handcuffs are applied to the prisoner's wrists, the officer may easily actuate the second locks to securely double-lock the handcuffs.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

Figure 2:
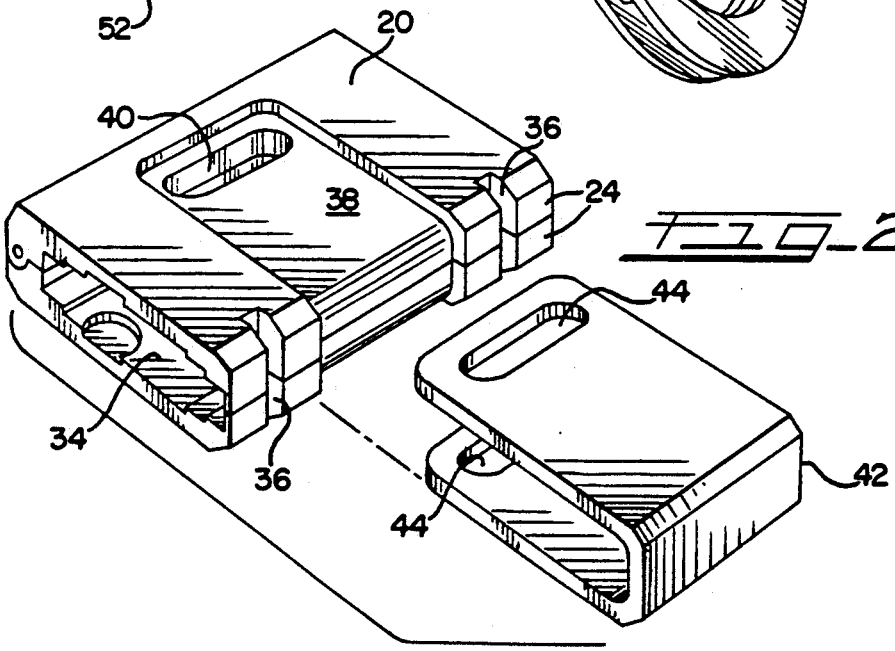
FIG. 2 is a similar view with the hinged sections of the shield body closed.

Referring with greater particularity to the drawings, the reference numeral 10 indicates generally a safety shield embodying the principles of the invention. Safety shield 10 comprises a box-like body 12 having a pair of plate-like members 14 and 16 hingedly connected along a sidewall by a hinge rod 18. The members 14 and 16 are substantial mirror images of each other, comprising an outer face 20, an inner face 22 and a sidewall 24 opposite the hinged connection. Each inner face 22 comprises a pair of raised sections 26 and 28 shaped to define a channel 30 therebetween and a pair of recessed areas 32, 32, opening to the opposite ends of the face 22. When the members 14 and 16 are operationally closed and brought into face-to-face contact, the recessed areas 32 provide a cavity 34 as seen in FIG. 2.

The sidewall 24 is formed with openings 36, 36, adjacent the opposite ends thereof which communicate with their respective recessed areas 32. In the embodiment illustrated, the openings 36 are formed by vertical cutouts or slots and, as seen FIGS. 2, 4 and 5, the mated slots of the operationally closed body 12 provide access means to the cavities 34 for reasons which will become apparent as the description proceeds.

A continuous recess or groove 38 is formed in and extends around the outer face 20 and sidewall 24 of each of the body members 14 and 16, and the raised sections 26 comprise oblong slots 40 opening to their respective outer faces. A channel-shaped retainer member 42 is slidably receivable in the continuous groove 38 of the closed body 12, and the legs of the retainer member have oblong slots 44, 44, of complementary configuration and adapted to align with the slots 40. The aligned slots 40 and 44 are adapted to receive a padlock, clip means, or a portion of the prisoner waist chain (not shown) for locking the shield 10 in the secure closed condition shown in FIGS. 4 and 5.

Figure 1:
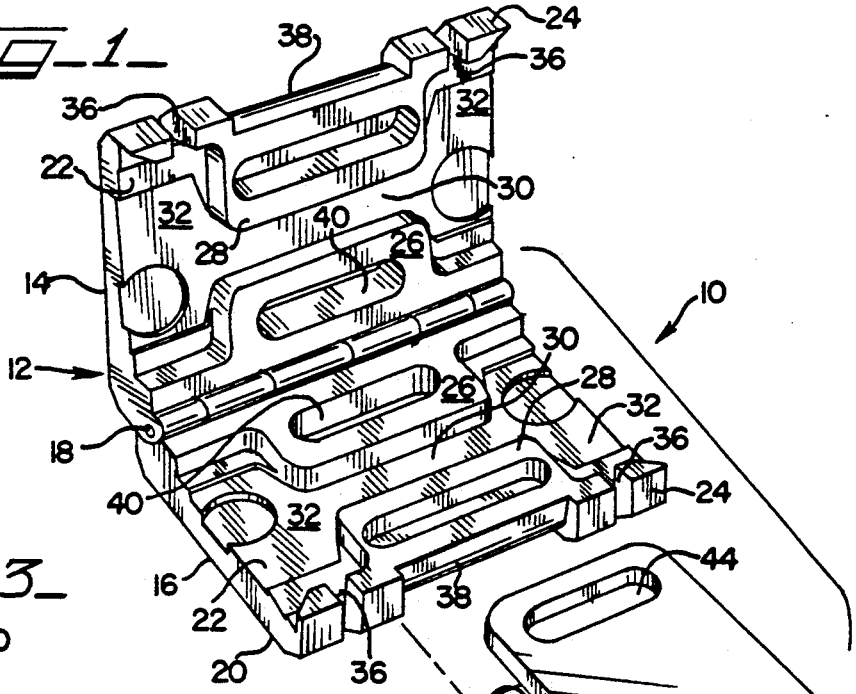
FIG. 1 is an exploded perspective view showing the shield of the invention in the open, inoperative position.
Figure 3:
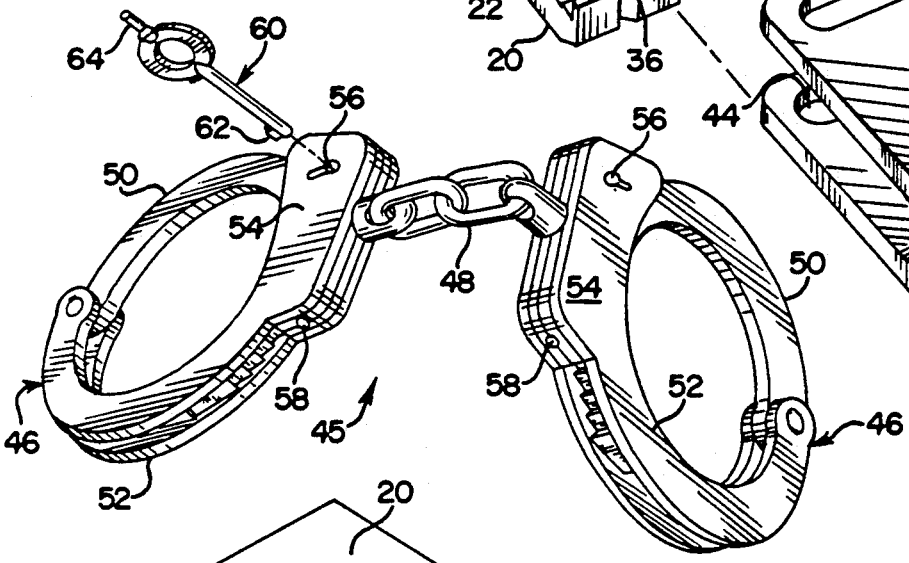
FIG. 3 is a perspective view of a set of conventional double-lock handcuffs and associated key.

Referring now to FIG. 3, there is illustrated a conventional set of double-lock handcuffs 45 comprising a pair of wristlets 46, 46, pivotally and rotatably connected by a short link chain 48. Each wristlet 46 comprises a ratchet bar 50 pivotally connected to a double strand wristlet body 52 having internal teeth (not shown) which permit rotation of the ratchet bar only inwardly therethrough, but automatically prevent withdrawal in the opposite direction. Wristlet body 52 comprises an enlarged head portion 54 carrying first lock means 56 in the form of a keyhole in a planar face thereof. Head portion 54 comprises further a second lock means 58 in the form of a small recessed rod engageable through a small hole in a side edge of the head portion.

A conventional key 60 cooperates with the handcuffs 45. Key 60 comprises at one end a finger 62 insertable into the first lock means keyhole 56. At its opposite end, the key 60 comprises a projection or pin 64 which is insertable into the opening in the side edge of the wristlet head 54 for actuating the second lock means 58.

Figure 4:
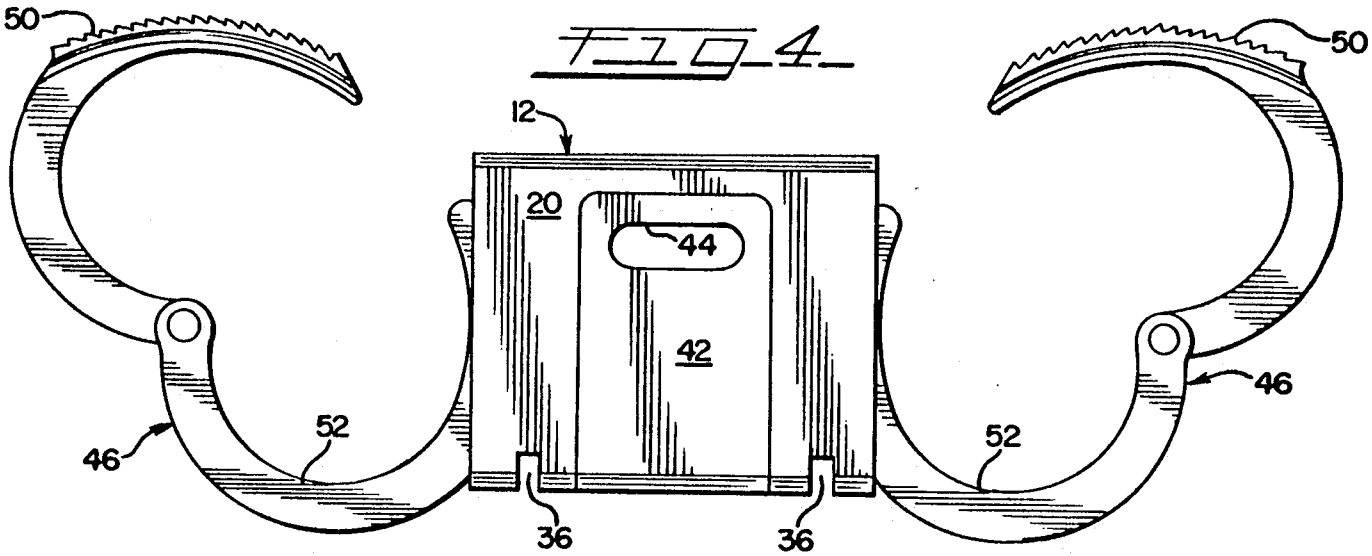
FIG. 4 is a plan view of the safety shield operationally locked over the handcuffs prior to application to the wrists of prisoner.
Figure 5:
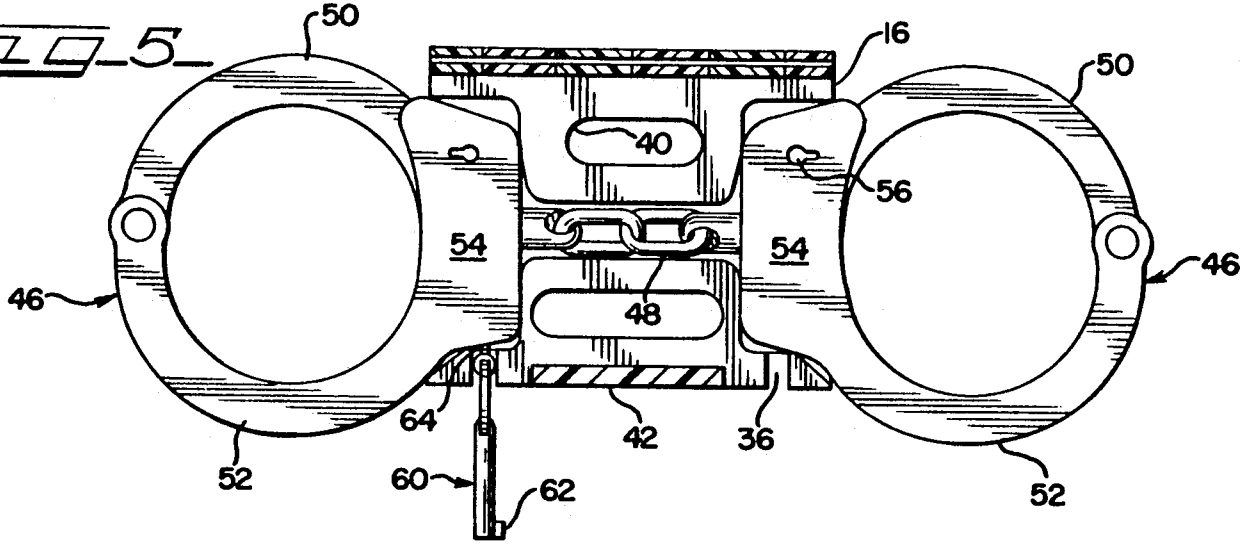
FIG. 5 is a similar view with portions broken away or in section and showing use of the key to actuate the second lock after application of the wristlets to a prisoner's wrists.

Operation of safety shield 10 may now be best appreciated by referring to FIGS. 4 and 5. Preparatory to shackling a prisoner, the officer can insert handcuffs 45 in the body 12 with the chain 48 in the channel 30 and the wristlet heads 54 in the cavities 34, close the body, apply the retainer member 42, and securely lock the rigid assembly with a padlock or the like. As illustrated in FIG. 4, the wristlets 46 may be in the open and disengaged condition. The officer can now apply the handcuffs to the wrists of a prisoner, set the wristlets to the desired encircling dimension and then actuate the second lock means 58 by pushing the key pin 64 through the access openings 36. When the handcuffs require removal, the finger 62 of the key 60 is inserted into the keyhole 56 to reset the second lock means and unlock the first lock means.

The shield parts may be conveniently molded of suitable plastics or metal, and it will be appreciated that the invention enables the officer to carry the handcuffs operationally secured in the safety shield at all times if desired. Even in dangerous situations where the officer is able to manacle only one wrist, the rigid assembly affords substantiall leverage for subduing the prisoner. If desired, or when conditions permit, the shield may of course be attached after the handcuffs have been applied to a prisoner's wrists. It should also be appreciated that the language and expressions used herein are for purposes of description only and changes and modifications may be made by thosed skilled in the art without departing from the spirit and scope of the invention which is defined in the appended claims.

What is claimed is:

1. A safety shield for handcuffs having a pair of wristlets connected by a chain, first lock means on each wristlet for disengagement and opening thereof after application to a wrist and second lock means on each wristlet for fixing the preset contracted position thereof on a wrist, comprising:

a rigid body having hinged members movable between open and closed positions operationally mountable on said wristlets to enclose said chain and first and second lock means and form a rigid connection between the wristlets; and access means on said rigid body for enabling access to said second lock means, whereby said rigid body is operationally mountable on said handcuffs before application to the wrists and said second lock means can be actuated after application to the wrists with said body members in the operationally closed position.

2. A safety shield according to claim 1 wherein each of said wristlets comprises an enlarged head portion having a substantially planar face and a side edge, said first lock means comprising a keyhole on said planar face, and said second lock means comprising a small hole opening to said side edge, said access means being in registry with said small hole when the body members are in operationally closed position on the handcuffs.

3. A safety shield according to claim 2 wherein said handcuffs comprise a key cooperable with said lock means, said key comprising at one thereof a pin projection insertable through said access means for engaging and actuating said second lock means.

4. A safety shield according to claim 3 wherein said hinged members in operationally closed position comprise cavities at opposite ends thereof for accommodating said wristlet head portions therein, and said access means comprises a pair of slots formed in a sidewall of each of the hinged members and communicating with said cavities.

5. In combination with double-lock handcuffs having a pair chain-connected wristlets, first lock means on each of said wristlets for disengagement and opening thereof after application to a wrist, second lock means on each wristlet for fixing the preset contracted position thereof on a wrist, and a key for operating the first and second lock means, a safety shield comprising:

a pair of plate-like members hingedly connected along a sidewall thereof and movable between an open and a closed position operationally mounted on said wristlets and enclosing said chain and first and second lock means and forming a rigid connection between the wristlets; and access openings formed in opposite sidewalls of said plate-like members, whereby said second lock means can be actuated by said key while the plate-like members are in the operationally closed position.

6. A combination according to claim 5 wherein said access openings comprise a pair slots formed in the opposite sidewalls of said plate-like members, said slots being in registry with the second lock means of each wristlet enclosed within the safety shield.

7. A combination according to claim 6 wherein said second lock means comprises a small hole on a side edge of each wristlet and said key comprises a pin projection at one end thereof, said slots accommodating passage of the pin projection therethrough and insertion into said hole for actuating the second lock means.

* * * * *